United States Patent [19]

Turtschan et al.

[11] Patent Number: 4,566,591

[45] Date of Patent: Jan. 28, 1986

[54] MULTIPLE PACKAGING DEVICE

[75] Inventors: Alfons Turtschan, Schwaebisch Hall; Herbert Drechsler, Vellberg, both of Fed. Rep. of Germany

[73] Assignee: Gasti-Verpackungsmachinen GmbH, Schwaebisch Hall, Fed. Rep. of Germany

[21] Appl. No.: 644,779

[22] Filed: Aug. 27, 1984

[30] Foreign Application Priority Data

Aug. 26, 1983 [DE] Fed. Rep. of Germany ..... 3330777

[51] Int. Cl.[4] ..... B65D 75/00

[52] U.S. Cl. ..... 206/427; 206/148; 206/429; 206/431

[58] Field of Search ..... 206/427, 429, 431, 433, 206/147, 148, 149, 157, 199, 443; 294/87.2

[56] References Cited

U.S. PATENT DOCUMENTS

| | | | |
|---|---|---|---|
| 2,823,062 | 2/1958 | Toensmeier | 294/87.2 |
| 3,021,001 | 2/1962 | Donofrio | 206/611 |
| 3,167,213 | 1/1965 | DePaul | 206/148 |
| 3,305,085 | 2/1967 | Rossi | 294/87.2 |
| 3,661,417 | 5/1972 | Inman | 294/87.2 |
| 3,772,846 | 11/1973 | Mueller | 206/429 |

FOREIGN PATENT DOCUMENTS

| | | | |
|---|---|---|---|
| 937549 | 11/1973 | Canada | 206/429 |
| 90455 | 11/1967 | France | 206/431 |
| 6516824 | 6/1966 | Netherlands | 206/199 |

*Primary Examiner*—William T. Dixson, Jr.
*Assistant Examiner*—Brenda J. Ehrhardt

[57] ABSTRACT

The invention relates to a multiple packaging system for a plurality of containers having edge flanges and being closable with covers, which containers are held together with a connecting element made of a flat cut-out. The cut-out is raised from underneath the containers to the underside of the edge flanges and is firmly attached to a cover sheet which makes up the covers. In addition, there are punched-out flaps in the cutout which can be inserted into one another to form a support structure between individual containers so that the stability of the multiple packaging system is improved.

10 Claims, 10 Drawing Figures

MULTIPLE PACKAGING DEVICE

BACKGROUND OF THE INVENTION

The invention relates to a multiple packaging device for containers which have lip flanges and covers, and which are held together by a connecting element made of cardboard or a similar existing material which grips the containers.

A known multiple packaging device is disclosed in published German patent application No. 30 47 467. The known device comprises a connecting element having a cut-out top face on which the top surfaces of the containers rest and side pieces which connect to each other through folds and perforations, and a corresponding bottom layer which connects to the top layer. Openings are provided in the top face in order to support the lip flanges of the containers, and in the bottom face, bridging pieces are provided which are folded over fold lines and are squeezed between the containers. The known multiple packaging device is expensive and has the serious disadvantage that the top and side surfaces of the packed containers are completely surrounded, which not only greatly increases material usage but also prevents the recognition of any markings which are imprinted on the containers. This can then only be rectified by imprinting the packaging system itself, which necessarily leads to very high costs and requires an added expense in each case. Lastly, known multiple packaging devices are connected at overlapping areas of their bottom surfaces, thus making it more difficult to break open a packaging system to remove single containers. Correspondingly, if a single container is removed, the entire pack is opened up, a result which is not always desired.

Some variations of the above described solutions are already employed in practice. With these variations, the packaging device does not surround the whole container but rather only in the upper most third, and is such that its connecting element grips the container in a box-type manner. In each case, however, a large material outlay is required and causes, as before, the disadvantage that the top surfaces of the containers are covered, so that the packaging system itself must be imprinted on its top side and, in some cases, the bottom side in order to identify the contents.

SUMMARY OF THE INVENTION

It is an object of the present invention to provide a multiple packaging system of the type already known in the art which can be produced easily and inexpensively using the least material necessary, while also having a stable and strong structure. This is achieved by the packaging system having a flat, cut-out piece which supports the underside of the edge flanges of the containers and which is rigidly connected to the covers of the containers.

It is an essential characteristic of the invention that the top as well as the sides of the containers remain completely uncovered, and not wholly or partially covered by the packaging device, so that the prior imprinted marking on the container is fully visible. Accordingly, an additional imprint of the packaging device is not necessary, so that substantial material and printing costs are saved.

The construction of the cut-out at the edge flange of the containers can be loose or rigid, i.e., in principle, the cut-out could be rigidly connected to the edges—for example, glued. If for any reason this is not desired, it is completely acceptable if the cut-out is rigidly connected to the covers of the containers. This is especially useful if the covers are made from one sheet of covers and are sealable to the containers. In this case, as a result of the connection between the sheet of covers and the packaging device, and because of the connection of the sheet of covers with the containers themselves, a stable arrangement of the containers is created within the multiple packaging device. In this way, the displayed surfaces are always arranged in the same direction and there is no possibility for the containers to spin around inside the multiple packaging device, for example, during transport.

In this case, production is simplified, especially in the case where the length and the width of the cover sheet are of the same dimensions as those of the cut-out. The connection between the cut-out and the cover sheet is very easy to achieve in that with cylindrical containers, the cut-out and the cover sheet are connected to each other at the edge areas to the side of the containers, e.g., through gluing, sealing or the like.

An especially stable multiple packaging system containing the discussed advantages can be achieved if the cut-out contains holes, corresponding to the number and diameter of containers to be picked up and flaps which bend over fold lines in the cut-out and point inwards towards the holes. After the insertion of the containers into the holes, the containers assume an essentially vertical position. Such flaps create essentially bridge-like supports on the side of the containers, so that it is now easy, according to the construction of the flaps, not only to leave them resting against the sides of the containers, but also to interconnect them to form a strong joint or connection.

The flaps may also be arranged in pairs with the next neighboring opening in the circumference region such that one flap acts as a tongue flap and the other flap acts as a groove flap into which the tongue flap is inserted. A stable arrangement then results if the tongue flap has a notched free end and the groove flap has two parallel creased lines so that when the flaps are folded at the fold lines an angle of approximately 90 degrees results and the tongue flap fits into the groove flap. In this way, a support framework results which resembles the numeral 4 from a side view.

The support effect can be further improved if the free end of the groove flap is shaped to the contour of the container, and if the next fold line in the groove flap has a perforated section such that when it is folded and the container is inserted there results another contour support.

The separation of the multiple packaging is made easier if the cut-out, and, when required, the cover sheet as well, contains perforation lines which extend from the edges of the cutout to the corners of the first perforation line of the grooved flap. In this way, a single container can easily be separated from the mutliple packaging system without upsetting the stability of the rest of the multiple packaging.

BRIEF DESCRIPTION OF THE DRAWINGS

With these and other objects in view, which will become apparent in the following detailed description, the present invention, which is shown by example only, will be clearly understood in connection with the accompanying drawing, in which.

DETAILED DESCRIPTION OF THE DRAWINGS

Figure 1:
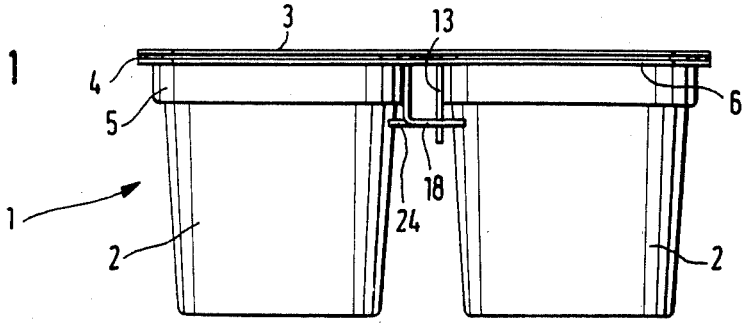
FIG. 1 shows a side view of a two-container multiple packaging system.
Figure 2:
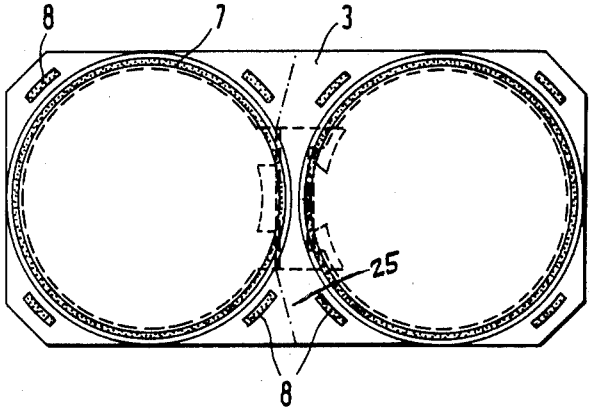
FIG. 2 shows the top view of the multiple packaging system of FIG. 1.

A multiple packaging system 1 displayed in FIGS. 1 and 2 is designed for two containers 2, which have their top surfaces covered by an aluminum cover sheet 3. The cover sheet 3 can have an advertising imprint in the area of the containers. The containers 2, which may be made out of plastic, for example, have an extending edge flange 4, and in some cases, a ring shelf 5, which extends somewhat over the lower conical contour of containers 2. Beneath edge flange 4 there is a cardboard connecting element in the shape of a flat cut-out 6 which is attached to the containers 2, which cut-out is shown alone in FIGS. 3 and 4.

After the containers are filled with a product (not shown), the cover sheet 3 and its sealant are brought in the general area of the seam 7 of the top side of the containers 2 and the cardboard cut-out 6 is brought up underneath the edge flange 4 of the containers 2 while the containers 2 are lowered in the manner described in detail below. Next, the cut-out 6 is sealed to the cover sheet 3 in the corner areas 8. As the cut-out 6 comes up from underneath, the imprinted top side of the cover as well as the cover sheet is exposed, so that the advertising imprint is clearly visible. This is equally true for any imprints on the side walls of the containers 2.

Figure 3:
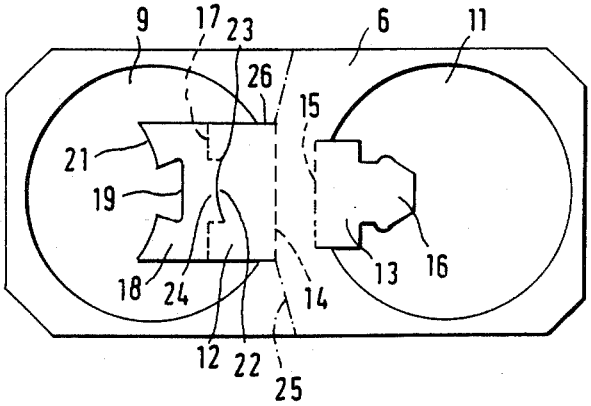
FIG. 3 shows a connecting element made out of a flat cut-out for the two-container multiple packaging system.
Figure 4:
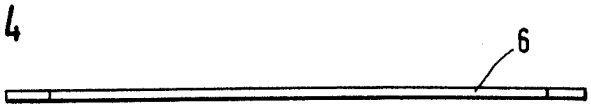
FIG. 4 shows the side view of the cut-out shown in FIG. 3.

As shown in FIG. 3, the cut-out 6 has a length and width approximately equal to that of the cover sheet 3. The cut-out 6 also contains openings 9 and 11 to accept containers 2. Furthermore, cut-out 6 contains flaps 12 and 13, whereby flap 13 is designed as a tongue flap and flap 12 is designed as a groove flap.

Flaps 12 and 13 fold over fold lines 14 and 15 respectively in such a manner that the flaps neighboring each other can be connected to each other in a manner further described below. Tongue flap 13 has a notched free end 16, and groove flap 12 has a dovetail-shaped notch 19 in support piece 18 which folds over a second fold line 17. Notch 19 connects together with the notched free end 16 of tongue flap 13, as will be further described below. At the free end of the support piece 18 there is a concave shaped support piece 21 and a corresponding opposite concave-shaped support piece 22 is created by perforation lines 23 in the first fold line 24.

After the insertion of the containers 2 into the holes 9, 11 of cut-out 6, the tongue flap 13 is folded over fold line 15 and the groove flap 12 is folded over fold line 14, so that the flaps 12, 13 attain an approximately vertical position with respect to the plane of the cutout. Next, support piece 18 is folded at a 90 degrees angle so that it rests against the right container 2 as shown in FIGS. 1 and 2, whereby the support surface 24 rests against the left container 2. In this manner, a support structure is formed, which, when viewed from the side, resembles the numeral 4. A stable multiple packaging system is created as the concave support surfaces 21 and 22 rest against the edges of the cylindrical containers 2.

A perforation line 25 is shown in FIGS. 2 and 3 which extends from approximately the mid-point of the edges of cut-out 6 to the corners formed by fold line 14 and cut lines 26.

Figure 5:
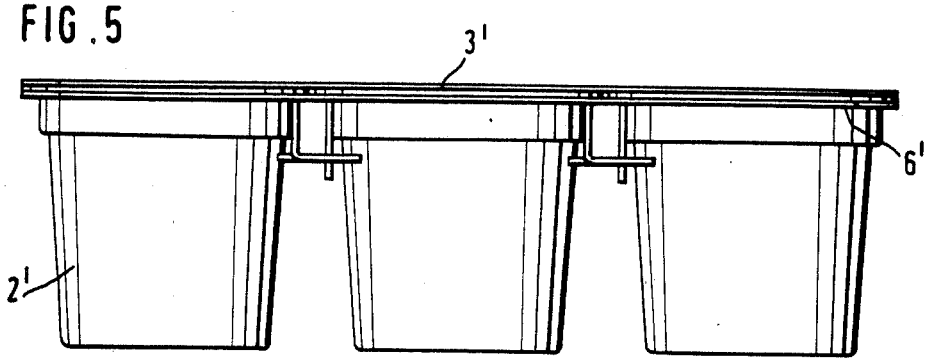
FIG. 5 shows a side view of a three-container multiple packaging system.
Figure 6:
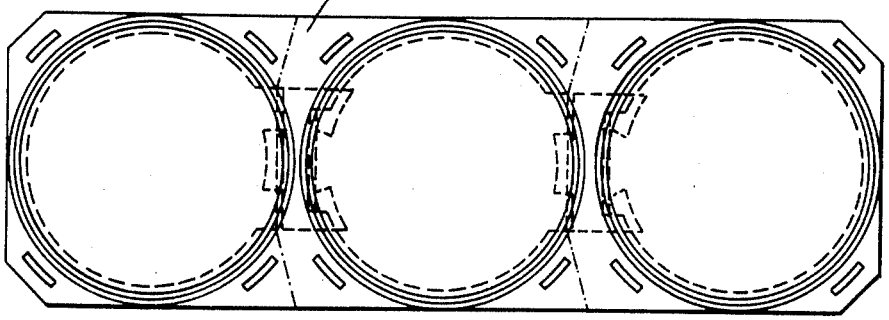
FIG. 6 shows the top view of the multiple packaging system shown in FIG. 5.
Figure 7:
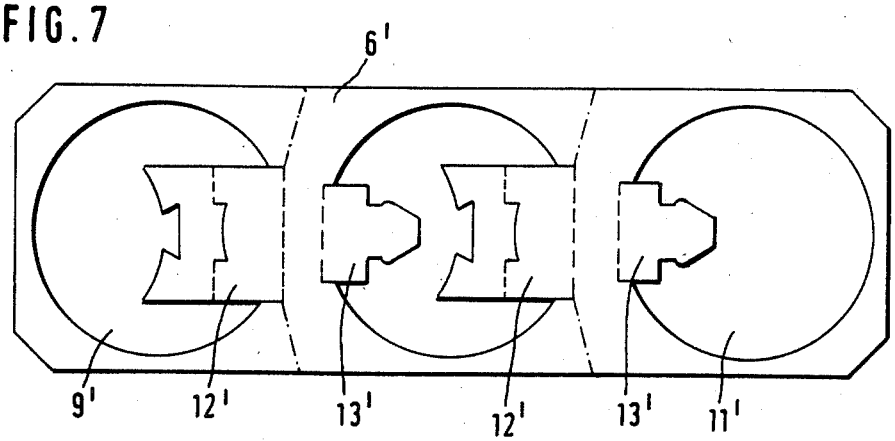
FIG. 7 shows the cut-out of a connecting element for the three-container multiple packaging system shown in FIGS. 5 and 6.

The embodiment shown in FIGS. 5 through 7 is identical to the afore-described embodiment with the exception that a three-container packaging system is shown rather than a two-container packaging system. Here, the reference numbers are provided with a superscript (prime). Containers 2' are held together by cover sheet 3' and cut-out 6', and once again bridge-like supports are formed by tongue flaps 13' and groove flaps 12'. Here too, the flaps 12' and 13' are arranged in pairs.

Figure 8:
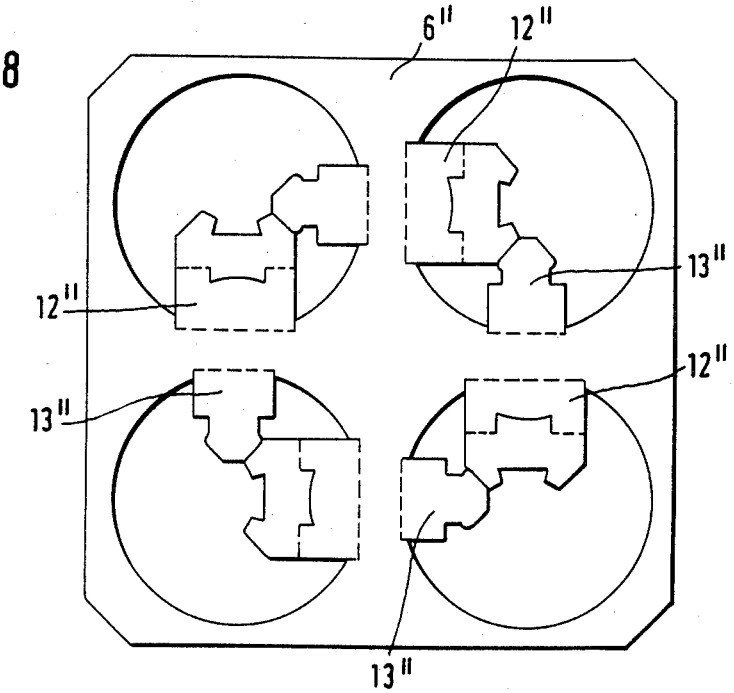
FIG. 8 shows a cut-out for a four-container multiple packaging system.

FIG. 8 shows a cut-out 6'' for a four-container multiple packaging system, whereby here too, the tongue flaps 13'' and the groove flaps 12'' are arranged in pairs, so that once again bridge-like supports can be built.

Figure 9:
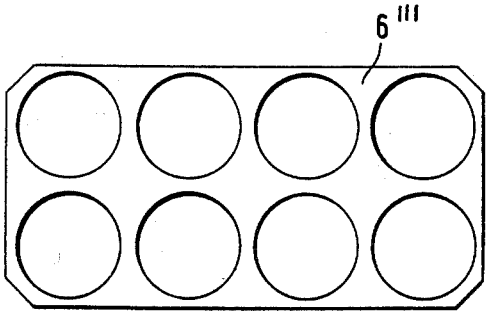
FIG. 9 is a schematic representation for an eight-container multiple packaging system.

FIG. 9 shows a cut-out 6''' for an eight-container multiple packaging system which holds eight containers, two rows of four next to one another.

Figure 10:
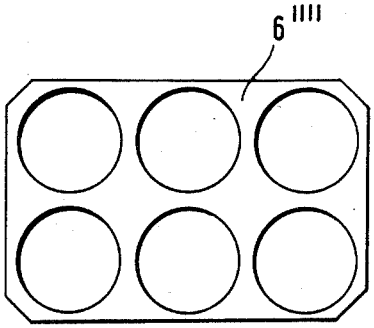
FIG. 10 is a schematic representation of a six-container multiple packaging system.

FIG. 10 shows a cut-out 6'''' for a six-container multiple packaging system.

It is to be understood that the invention is not limited to the diagrammed embodiments but can comprise other embodiments. Naturally, multiple packaging systems can be made containing other numbers of containers than those shown. The required size of the multiple packaging system depends on the requirements of the container filler machine, so that a possibility exists for the integration of the production of the multiple packaging systems at the end of a filling and sealing plant.

We claim:

1. A multiple packaging system for containers which have edge flanges and are closable with covers, wherein containers are held together by a connecting element which grips the containers, said connecting element comprising a flat cut-out which supports the edge flanges of the containers from the underside and is firmly connected to the covers of the containers, wherein the covers comprise a cover sheet which is sealable to the containers and is attached to the containers, and the length and width of the cover sheet have the same dimensions as those of the cut-out and the containers are of tubular configuration and the cut-out and the cover sheet are attached to each other in the corners on the sides of the containers.

2. A multiple packaging system according to claim 1 wherein the cut-out, corresponding to the number of containers to be held, has openings which fit the diameter of the containers and which contains flaps which point towards the openings and fold over fold lines, which flaps assume an essentially vertical position with respect to the plane of the cut-out after the insertion of the containers.

3. A multiple packaging system according to claim 2, wherein the flaps are arranged in pairs with respect to the neighboring openings in the cut-out, and one flap of each pair is designed as a tongue flap and the other flap of each pair is designed as a groove flap.

4. A multiple packaging system according to claim 3, wherein the tongue flap has a notched free end and the groove flap bends over parallel fold lines, forming a support structure, which, after the insertion of the containers, forms an approximately 90 degrees angle so that the notched end of the tongue flap fits into a dovetail-shaped notch in the groove flap.

5. A mutliple packaging system according to claim 4, wherein the groove flap has a free end with a support edge which follows the contour of the containers.

6. A multiple packaging system according to claim 5, wherein opposite the free end of the groove flap there is an extending support lobe which rests against the inserted container.

7. A multiple packaging system according to claim 6, wherein the support lobe has the shape of the contour of the containers at the point along the height of the containers where the support lobe rests.

8. A multiple packaging system according to claim 1, wherein the cut-out and the cover sheet can be ripped along perforation lines in order to facilitate the separation of a single container packaging from the multiple packaging system.

9. A multiple packaging system according to claim 8, wherein the perforation lines in the cut-out extend to the corners formed by the cut line and the fold line of the groove flap.

10. A multiple packaging system according to claim 1, wherein the containers have a frusto-conical shape, the end of each container which has the larger diameter being supported in said connecting element.

* * * * *